United States Patent [19]

Neese

[11] 4,454,396

[45] Jun. 12, 1984

[54] ELECTRICAL SWITCH FOR THICK/THIN FILM CIRCUITS

[75] Inventor: Wayne E. Neese, Hoffman Estates, Ill.

[73] Assignee: GTE Automatic Electric Inc., Northlake, Ill.

[21] Appl. No.: 384,695

[22] Filed: Jun. 3, 1982

[51] Int. Cl.[3] ..... H01H 9/00

[52] U.S. Cl. ..... 200/292; 200/6 R; 200/11 R; 200/11 G; 200/281

[58] Field of Search ..... 200/292, 11 G, 11 K, 200/11 TW, 155 R, 155 A, 252, 335-338, 280, 281, 6 R, 6 C, 11 R, 11 A, 11 D, 11 DA

[56] References Cited

U.S. PATENT DOCUMENTS

| | | | |
|---|---|---|---|
| 1,732,731 | 10/1929 | Samuels et al. | 200/281 X |
| 1,992,827 | 2/1935 | Kunneke | 200/11 G |
| 2,391,479 | 12/1945 | Rivers | 200/252 |
| 2,558,412 | 6/1951 | Baldwin | 200/11 G |
| 2,848,567 | 8/1958 | Estoppey et al. | 200/292 X |
| 3,104,299 | 9/1963 | Koci et al. | 200/11 TW |
| 3,462,562 | 8/1969 | Norman | 200/252 X |
| 3,518,389 | 6/1970 | Doering et al. | 200/292 X |
| 3,996,440 | 12/1976 | Niconienko | 200/155 A |
| 4,267,412 | 5/1981 | Janssen et al. | 200/11 G X |
| 4,390,757 | 6/1983 | Wiessner | 200/11 G |

FOREIGN PATENT DOCUMENTS

| | | | |
|---|---|---|---|
| 600628 | 3/1978 | U.S.S.R. | 200/11 TW |

*Primary Examiner*—Stephen Marcus
*Assistant Examiner*—Ernest G. Cusick
*Attorney, Agent, or Firm*—Anthony Miologos; Robert J. Black

[57] ABSTRACT

A device for selectively connecting a plurality of circuit elements in a thick/thin film circuit comprising, a pivot pin mounted to the film circuit and a manually rotatable contact element mounted to the pin. Contact fingers emanating from the contact element communicate with contact pads connecting a different set of film circuit elements together each time the contact element is rotated.

6 Claims, 4 Drawing Figures

ELECTRICAL SWITCH FOR THICK/THIN FILM CIRCUITS

BACKGROUND OF THE INVENTION (1) Field of the Invention

This invention relates in general to an electrical switch means and more particularly to a switch for use with film circuits.

(2) Description of the Prior Art

Many different kinds of switching devices are known which are used in electrical circuits for switching elements in or out of circuits thereby selectively changing circuit values. This holds true in thick/thin film circuits where it has been found to be advantageous to selectively add or subtract circuit elements allowing the circuit to operate in several different input-output configurations.

Former methods of accomplishing switching functions in thick/thin film circuits were to solder and de-solder wire conductors between solder pads or to use commercial switches either soldered to the substrate or outboarded.

The disadvantages of soldering and de-soldering conductor wire is an obvious one. This method is time consuming and requires special equipment. Special care in soldering minute circuits is required which becomes increasingly difficult to perform on circuits mounted onto an assembly. In addition the number of soldering operation which can be performed is extremely limited, as molten solder leaches away the solder pad (contact pad) destroying the thick/thin film circuit.

The problem with switches soldered to thick/thin film circuits is that they are too large and cumbersome in relationship to the size of the circuit in which they are used. This disadvantage is particularly significant in thick/thin film circuitry because in such circuits the switches may occupy more space than the rest of the circuit thereby placing a limit on the physical size thereof.

Finally switches which are outboarded require specialized circuitry and thus make the circuit more complex.

It is therefore an object of the present invention to provide an electrical switch mountable on a thick/thin film circuit arranged to be manipulated to selectively switch between elements on a thick/thin film circuit.

SUMMARY OF THE INVENTION

In accomplishing the object of the present invention there is disclosed a switch actuator comprised of a pivot pin and a main contact element. The pivot pin is a single screw machine part which is solder re-flowed to the thick/thin film substrate. The main contact element is a formed metal stamping having good electrical conducting properties which is snapped onto the pivot pin becoming self retaining. Trifurcated contact finger groups formed from the main contact element are disposed to contact associated conductor pads on the thick/thin film substrate surface. In a contact element having two contact finger groups three contact pads are grouped about the pivot pin and used to configure the switch as a single pole double throw switch. One of the contact pads is used as the pole and the contact element manually rotated 90° to selecting either one of the other remaining contact pads.

It should be noted, that more than two contact finger groups as well as more than three contact pads may be used in order to configure additional switch groupings.

This design has a feature in its low profile, simplicity of manufacture and accessibility particularly in the field.

BRIEF DESCRIPTION OF THE DRAWINGS

A better understanding of the invention can be had from the consideration of the following detailed description taken in conjunction with the accompanying drawings in which.

DESCRIPTION OF THE PREFERRED EMBODIMENT

Figure 2:
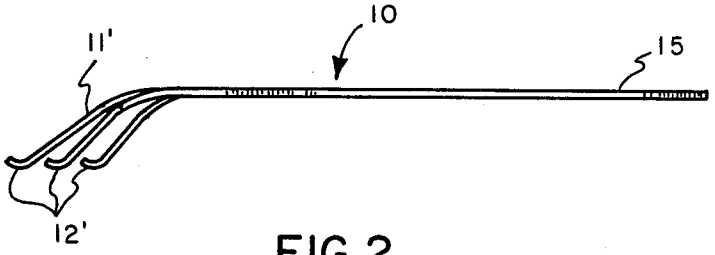
FIG. 2 is an elevational view of the contact element.
Figure 1:
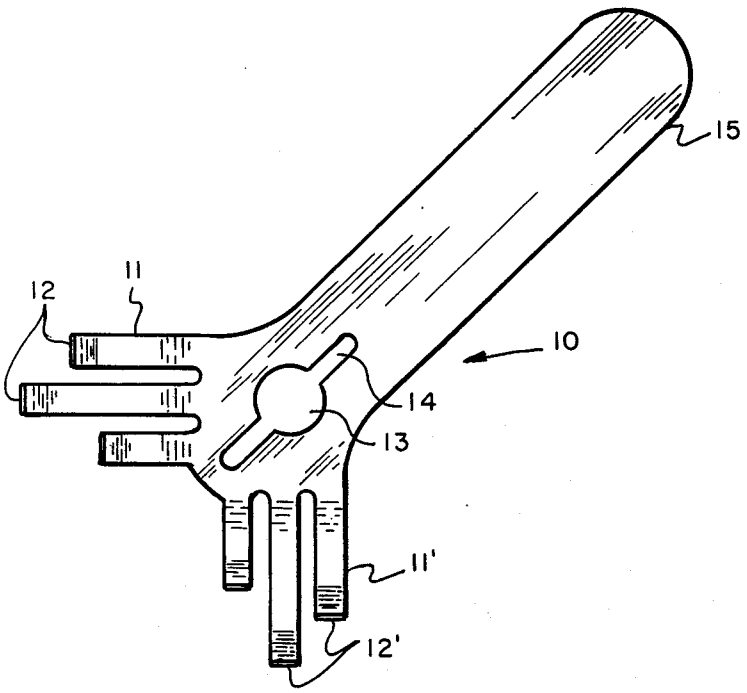
FIG. 1 is a top plan view of the contact element in accordance with the present invention.

Turning now to FIGS. 1 and 2, the main contact element 10 of the present invention is illustrated. Contact element 10 is a formed metal stamping made from a good conductive material such as phosphor bronze or the like. Contact element 10 is generally Y-shaped and includes two groups of trifurcated spring contact fingers 11 and 11' and a handle portion 15. The contact finger groups 11, 11' are formed at approximately 90° to each other and are bent downwardly. The trifurcation as well as the unequal length of fingers 11, 11' allow for the application of equal pressure to the contacting surfaces and a minimum of contact resistance. Each end of each contact finger is swept upward forming contact wiper portions 12 and 12' as can be seen in FIG. 2.

Figure 4:
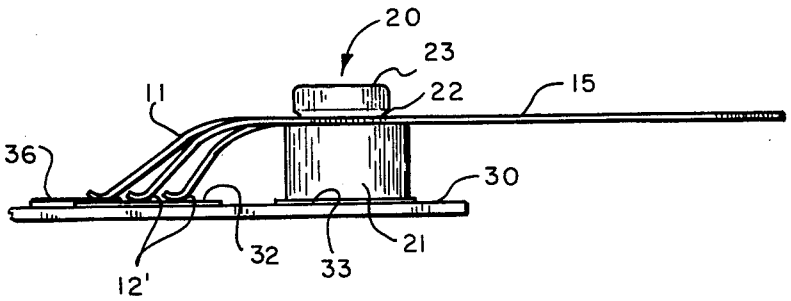
FIG. 4 is an elevational view of FIG. 3.
Figure 3:
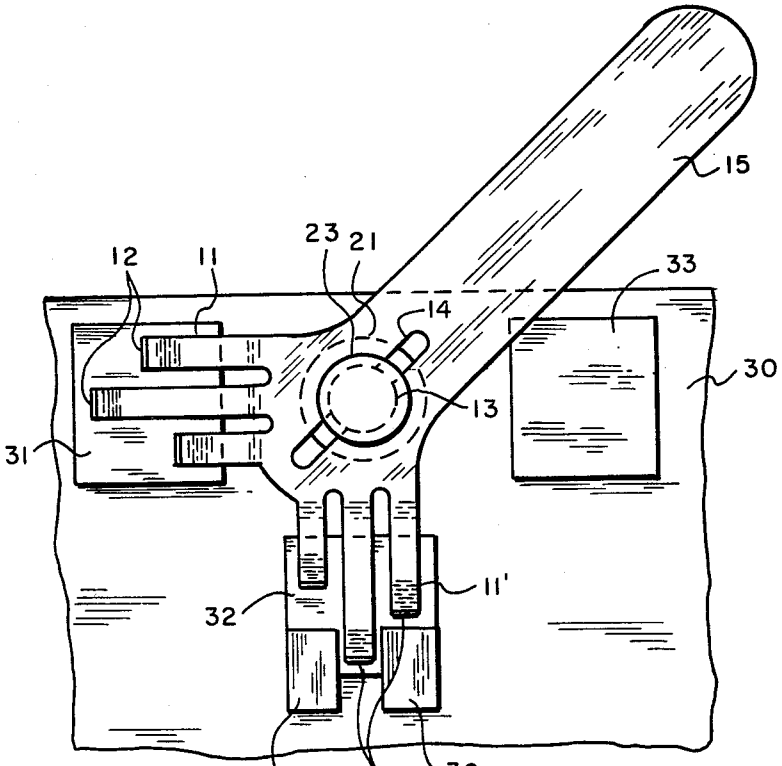
FIG. 3 is a top plan view of the contact element mounted on a partial illustration of a thick/thin film circuit.

A centrally located opening 13 including kerfs 14 allow the contact element to be snapped onto a pivot pin 20 illustrated on FIGS. 3 and 4.

Turning now to FIGS. 3 and 4 a partial illustration of a thick/thin film substrate 30 is shown. A grouping of contact pads 31, 32 and 33 are screened onto a dielectric substrate surface in the case of a thick film circuit and screened or sputtered in the case of a thin film circuit. The contact pads would of course be electrically connected to various parts of the thin/thick film circuit via conductive traces not shown here for reasons of clarity.

The second element of the present invention a pivot pin shown generally as 20 includes a broad base 21 a neck portion 22 and head portion 23. The pivot pin is constructed from a good conductor material and is solder reflowed to the substrate surface leaving an equidistant space of dielectric substrate between the pivot pin and contact pads 31, 32 and 33.

Contact element 10 is mounted to pivot pin 20 via aperture 13 mating with head 23. Radial arms 14 allow the aperture 13 to expand allowing the contact element to fit over head 23 snap fitting into neck 22. With contact element 10 installed on the pivot pin the contact element is horizontally rotatable about neck 22. As can be readily seen in FIG. 3 the trifurcated contact groups 11 and 11' register over an associated contact pad in this case 31 and 33 respectively when the contact element is installed on the thick/thin film circuit. Handle 15 extends over the edge of thick/thin film substrate 30 rendering it readily accessible in the field.

In this embodiment the switch is configured as a single pole double throw switch. Pad 33 becomes the pole with contact wipers 12' forming a conductive path from pad 33 through the contact element 10 to contact pad 31 via contact wipers 12. When contact element 10 is rotated to the left by applying a manual pressure to handle 15 contact wiper 12 is moved to the right forming a conductive path from pad 33 through contact element 10 to pad 32 via contact wiper 12'.

In cases where vibration may be present the contact element may be locked in place by screening additional layers of film material to opposite ends of one of the pads such as pad 33. Mounds 35 and 36 lock the respective contact wiper in place thereby decreasing the chances of jarring the switch from its selected position.

Even though the embodiment of the present invention is shown with a single pole double throw switching configuration it will be appreciated by those skilled in the art, that by the addition of other contact fingers and respective contact pads other switching configurations can be made. Additionally, in situations where required, the pivot pin may be electrically connected to the circuit thereby coming the common pad or pole and the contact element providing the conductive path to two or more contact pads through an appropriate number of contact wipers.

Although the best modes contemplated for carrying out the present invention have been herein shown and described, it will be apparent that modification and variation may be made without departing from what is regarded as the subject matter of the invention.

What is claimed is:

1. An electrical switching device arranged to electrically connect a plurality of electrical film circuits deposited on an appropriate substrate, said plurality of electrical film circuits each including at least one contact pad, said switching device comprising:

a pivot pin located adjacent to and equidistant from each contact pad, said pivot pin including a base section with a bottom surface fixidly mounted to said substrate and a head section including a wide top portion tapering down into a narrower width away from said top portion forming a neck portion, said neck portion integrally joined to a base section top surface;

a contact element including a mounting portion and connecting means extending from said mounting portion, said mounting portion including a centrally located orifice having at least a pair of kerfs extending radially from said orifice, said orifice arranged to slip over said pivot pin head section with said kerfs allowing said orifice to expand fitting over said head section and resting on said base section top surface, allowing said contact element to be manually rotatable about said neck portion into at least a first position, whereby in said first position said connecting means communicate with a different contact pad connecting at least two of said electrical circuits forming a first connected set.

2. The switching device claimed in claim 1, wherein: said contact element is manually rotated into a second position, and said connecting means communicate with a different contact pad forming a second connected set between at least one electrical circuit of said first connected set and at least one of said plurality of electrical circuits.

3. The switching device claimed in claim 1, wherein: said contact elements connecting means is comprised of a pair of trifurcated contact finger groups each contact finger group is arranged 90° to the other.

4. The switching device claimed in claim 3, wherein: said pair of trifurcated contact finger groups each include fingers of unequal length and each finger includes an end portion, each end portion is swept upward forming a contact wiper with each contact wiper contacting a respective contact pad.

5. The switching device claimed in claim 1, wherein: said contact element further includes a handle extending from said mounting portion, said handle arranged to be manually manipulated to rotate said contact element.

6. The switching device claimed in claim 5, wherein: said contact element said handle and said connecting means are an integral unit formed from an electrically conductive material.

* * * * *